US006750821B2

(12) United States Patent
Fang et al.

(10) Patent No.: US 6,750,821 B2
(45) Date of Patent: Jun. 15, 2004

(54) FOLDED DUAL-BAND ANTENNA APPARATUS

(75) Inventors: Shyh-Tirng Fang, Tainan (TW); Fa-Hsien Chang, Kaohsiung (TW); Kin-Lu Wong, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/345,297

(22) Filed: Jan. 15, 2003

(65) Prior Publication Data

US 2004/0017329 A1 Jan. 29, 2004

(30) Foreign Application Priority Data

Jul. 24, 2002 (TW) ..... 91116520 A

(51) Int. Cl.[7] ..... H01Q 3/02
(52) U.S. Cl. ..... 343/700 MS; 343/767
(58) Field of Search ..... 343/700 MS, 767, 343/770

(56) References Cited

U.S. PATENT DOCUMENTS 6,008,762 A * 12/1999 Nghiem ..... 343/700 MS
6,124,831 A * 9/2000 Rutkowski et al. .. 343/700 MS
6,133,880 A * 10/2000 Grangeat et al. .... 343/700 MS

* cited by examiner

*Primary Examiner*—Wilson Lee
(74) *Attorney, Agent, or Firm*—Thomas, Kayden, Horstemeyer & Risley

(57) ABSTRACT

A folded dual-band monopole antenna apparatus is disclosed, which includes a radiation body, a transmission line and a conductor. The radiation body resonates at a first and a second operating frequency. The radiation body connects the transmission line by way of the conductor. The radiation body includes a first side and a corresponding second side, and slits are set alternately on the first side and the second side to make the radiation body to be a meandered structure. The radiation body is folded along an extended direction of the slits to form a pillar structure for size miniaturization. The radiation body can cover a surface of a pillar dielectric material structure by printing technology for further size miniaturization and improving the strength of the radiation body.

10 Claims, 7 Drawing Sheets

FOLDED DUAL-BAND ANTENNA APPARATUS

This application claims the benefit of Taiwan application Serial No. 091116520, filed Jul. 24, 2002.

BACKGROUND OF THE INVENTION

1. Field of the Invention

The invention relates in general to a dual-band antenna apparatus, and more particularly to a folded dual-band antenna apparatus 2. Description of the Related Art As a result of the recent rapid advance of the wireless technology, mobile communication devices become much more popular than ever. For a mobile phone, one of the most popular mobile communication devices, size miniaturization and high communication quality are the basic requirements. Furthermore, superior dual-band characteristic, compact feature, and low manufacturing cost are also important elements for a mobile phone manufacturing industry.

The conventional antenna used for the mobile phone is an exposed linear monopole antenna. One of the drawbacks of it is that the exposed antenna can be easily broken and is inconvenient to carry. The extended antenna usually catches things unexpectedly. Furthermore, the manufacturing cost of the conventional antenna is high, and the application of the exposed linear monopole antenna in a dual-band or multi-band mobile phone makes the whole structure complicated. Thus, the conventional antenna cannot satisfy current demands, like miniaturization.

SUMMARY OF THE INVENTION

It is therefore an object of the invention to provide a folded dual-band monopole antenna with small size and low profile. In addition to foregoing advantages, the invention can protect the monopole antenna from damage, and increase the liability of the monopole antenna.

In accordance with the object of the invention, it provides a folded dual-band monopole antenna. The folded dual-band monopole antenna comprises at least a radiation body, a transmission line and a conductor. The radiation body resonates at a first operating frequency and a second operating frequency. The radiation body connects the transmission line by way of the conductor. The radiation body includes a first side and a second side corresponding to the first side. A number of slits are set alternately on the first side and the second side so that the radiation body is formed to be a meandered structure. In addition, a feeding point is set on the radiation body for defining a first current path and a second current path on the radiation body. The length of the first current path is a quarter of a wavelength corresponding to the first operating frequency, and the length of the second current path is a quarter of a wavelength corresponding to the second operating frequency.

It is noticed that the radiation body is folded along an extended direction of the slits to form as a pillar structure for size miniaturization. The radiation body can cover a surface of a pillar dielectric material structure by printing technology for further size miniaturization and improving the strength of the radiation body.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

The major parts of an antenna include a radiation body and a transmission line. The transmission line is used for transmitting signals, and the radiation body resonates at some particular bands so that the antenna can operate at one or more operating frequencies.

Figure 1:
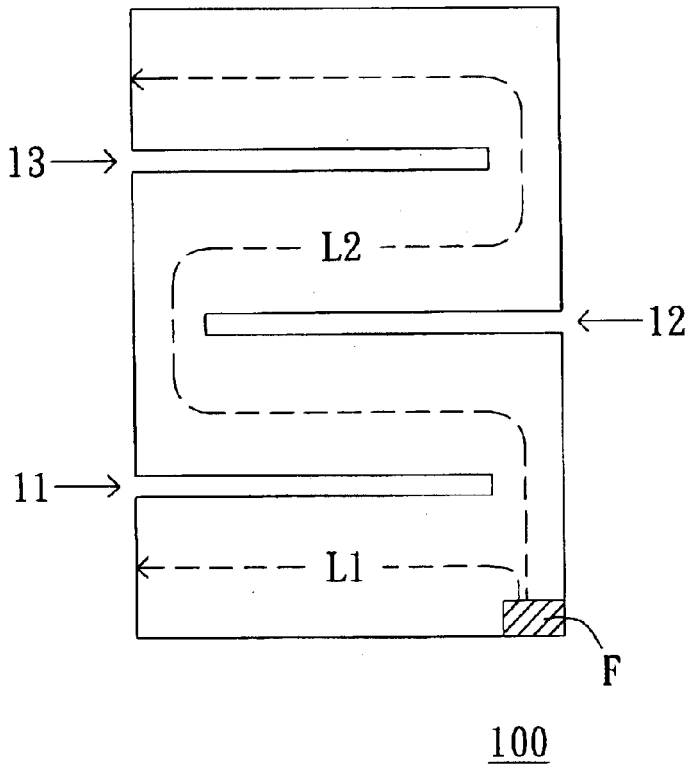
FIG. 1 illustrates a radiation body of a folded antenna apparatus according to a preferred embodiment of the invention.

Referring to FIG. 1, it illustrates a radiation body 100 of a folded antenna apparatus according to a preferred embodiment of the invention. A rectangular metal plate is a preferred material for the radiation body 100. A plurality of slits are set alternately on two corresponding sides, such as a left side and a right side, of the radiation body 100. For example, the slits include slits 11 and 13, which are set on the left side, and the slit 12, which is set on the right side. The slits 11, 12 and 13 are in parallel so that the size of the antenna can be miniaturized to a meandered structure. If a feeding point F of the antenna is set on the right down corner, two current paths L1 and L2 with different lengths are formed accordingly. The length of the current path L1 is shorter than the length of the current path L2, so that the current path L1 can resonate in the high frequency band, and the current path L2 can resonate in the low frequency band to fit the design requirements of a dual-and antenna.

The characteristic of a conventional monopole antenna is that its operating length is a quarter of the operating wavelength (i.e. $\lambda/4$, where $\lambda$ is the wavelength), which corresponds to the resonance frequency. To enable the antenna to operate in both the GSM (890~960 MHz) band and-the DCS (1710~1880 MHz) band, the antenna need to be designed to operate at two operating frequencies, 900 MHz and 1800 MHz, and the two lengths of current path L1 and current path L2 are accordingly designed (the length of current path L1 is a quarter of the operating wavelength corresponding to the frequency 1800 MHz, and the length of current path L2 is a quarter of the operating wavelength corresponding to the frequency 900 MHz). For further miniaturizing the size of the monopole antenna, the radiation body 100 can be folded to a three-dimensional pillar structure. Although the thickness of the folded monopole antenna increases, the area that the folded monopole antenna occupies dramatically reduces, and the antenna can has a low profile to the system ground plane.

Figure 2A:
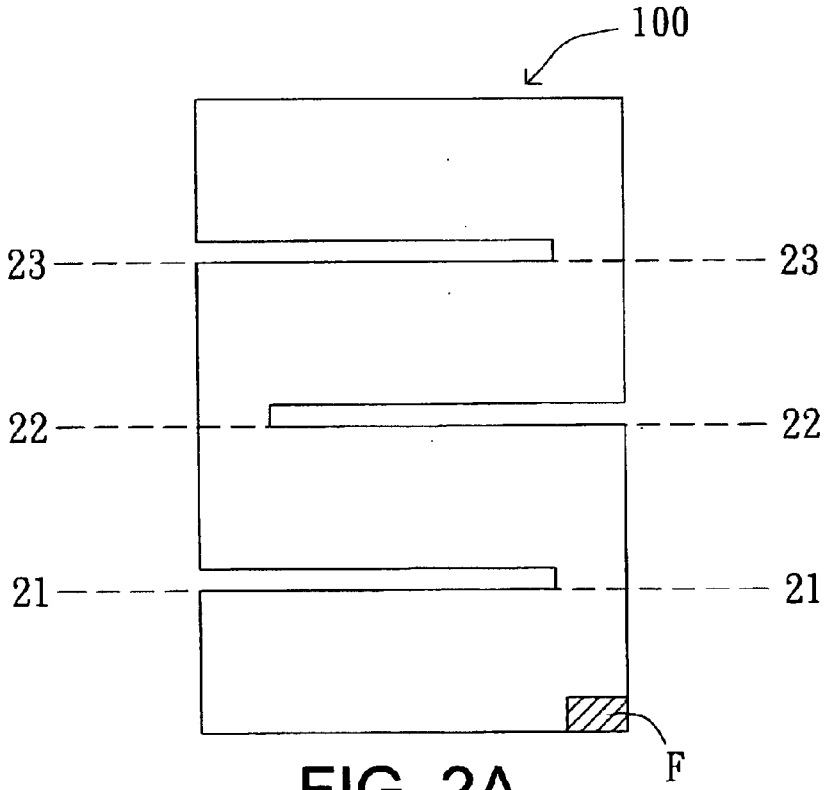
FIGS. 2A~2C illustrate a folding process of the radiation body of the folded antenna apparatus shown in FIG. 1.
Figure 2B:
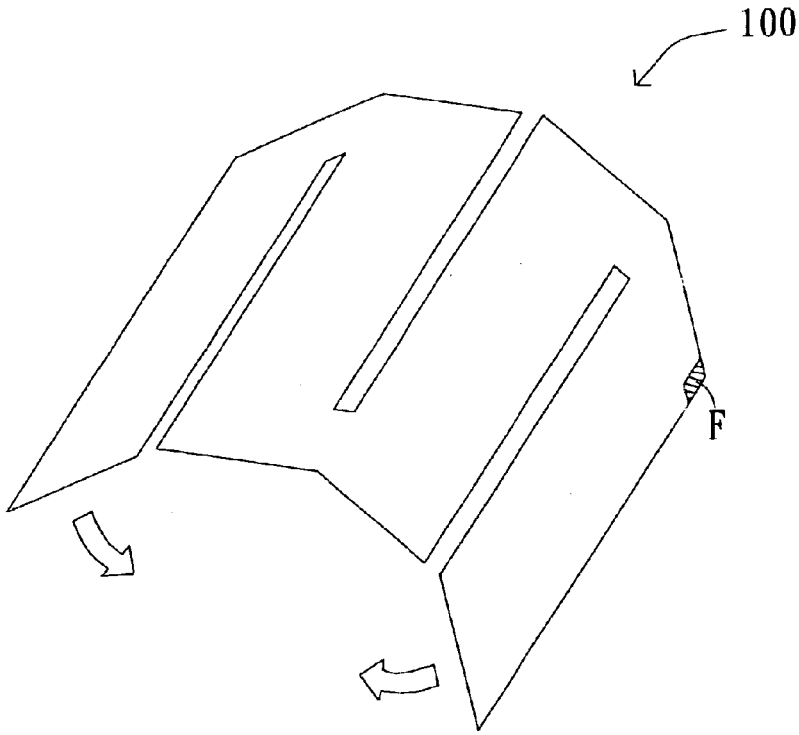
Figure 2C:
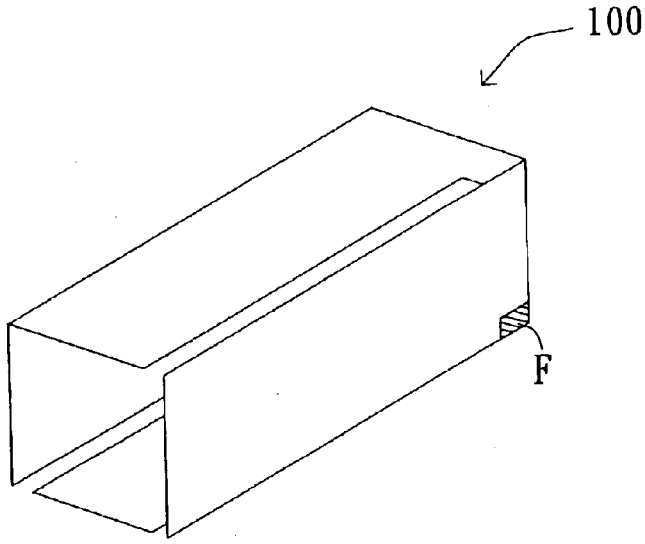

Referring next to FIG. 2A, it illustrates folding lines of the radiation body of the folded antenna apparatus shown in FIG. 1. The folding lines are set along the extended directions of the slits 11, 12 and 13, such as folding lines 21—21, 22—22, and 23—23, etc. The radiation body 100 can be folded along the folding lines 21—21, 22—22, and 23—23, as shown in FIG. 2B. The radiation body 100 is folded to a three-dimensional pillar structure, as shown in FIG. 2C. The radiation body 100 can also be folded not along any folding lines. For example, the radiation body 100 can be rolled up directly to form a three-dimensional cylinder structure so that the size of the monopole antenna is miniaturized.

In view of the current printing technology, a pattern can be directly printed on a surface of a dielectric material. Thus, the manufacturing process of the invention does not necessarily include the steps of: first making the piece-like radiation body 100, and then folding the radiation body 100 into a pillar structure. Alternatively, we can achieve the same result by firstly forming a dielectric material as a rectangular pillar or a cylindrical structure, and then coating the surface of the dielectric material by the radiation body 100, by the printing technology. In application, the ceramic material can be used as a dielectric material and the radiation body can be formed on the surface thereof. In the case, the radiation body itself has a structure with great strength. Together with the high dielectric constant characteristic of the ceramic material, the total radiation body can therefore be effectively miniaturized.

Figure 3:
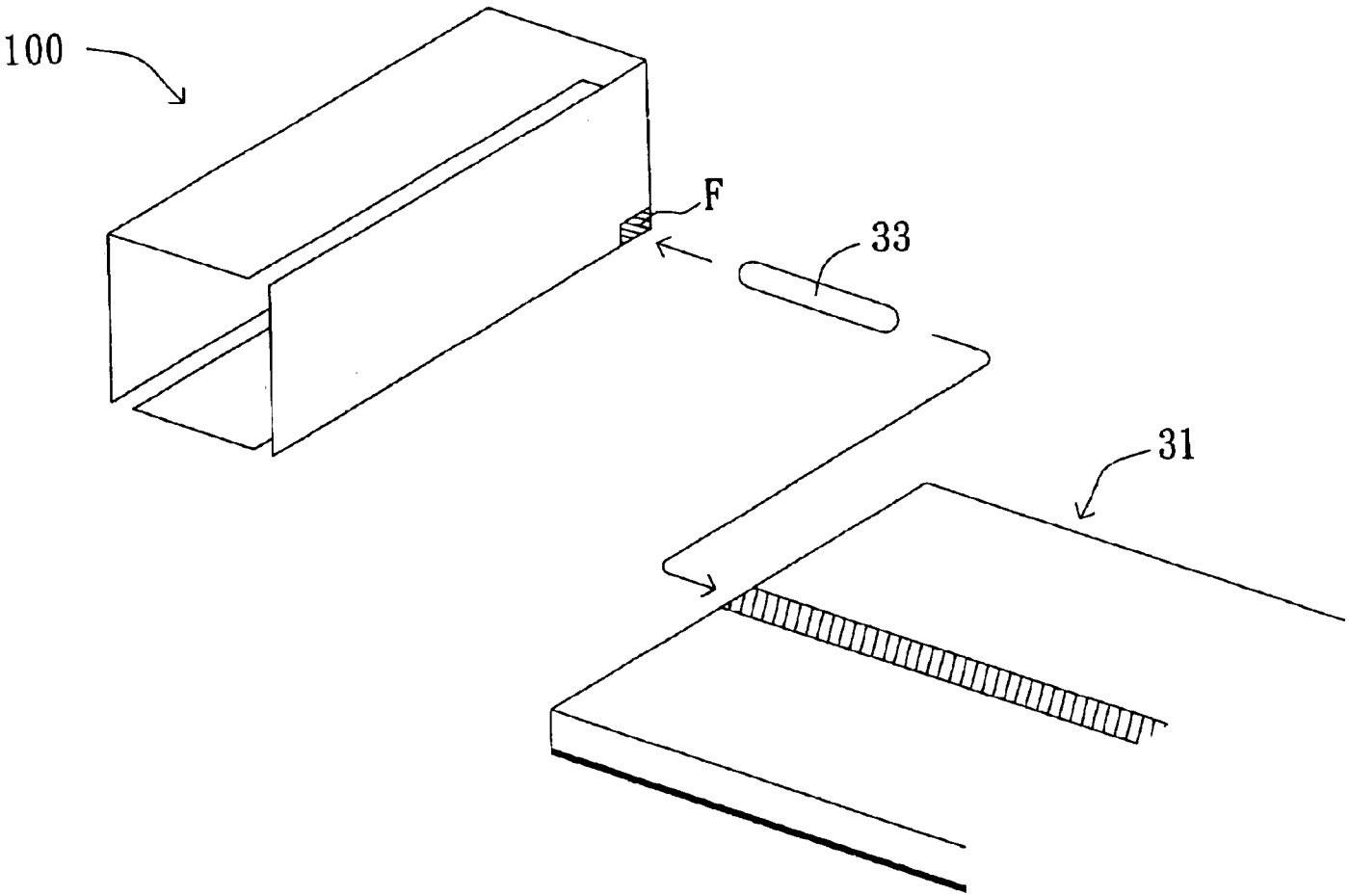
FIG. 3 illustrates the radiation body connecting a transmission line of the folded antenna apparatus according to the preferred embodiment of the invention.

Referring next to FIG. 3, it illustrates the connection between the radiation body 100 and a transmission line 31 of the folded antenna apparatus. Among variety of the microwave circuits, there are many types of transmission lines, such as microstrip line, coplanar waveguide (CPW) and coaxial cable, etc. In FIG. 3, the microstrip line 31 is taken as an example. Since the radiation body 100 is a monopole antenna, a conductor 33 with proper length must be used for connecting the feeding point and the microstrip line 31 to prevent the grounding surface of the microstrip line 31 from contacting the radiation body 100. It is noticed that the invention does not need any additional matching circuits to achieve good impedance matching in two operating bands and the cost is thus reduced.

Figure 4A:
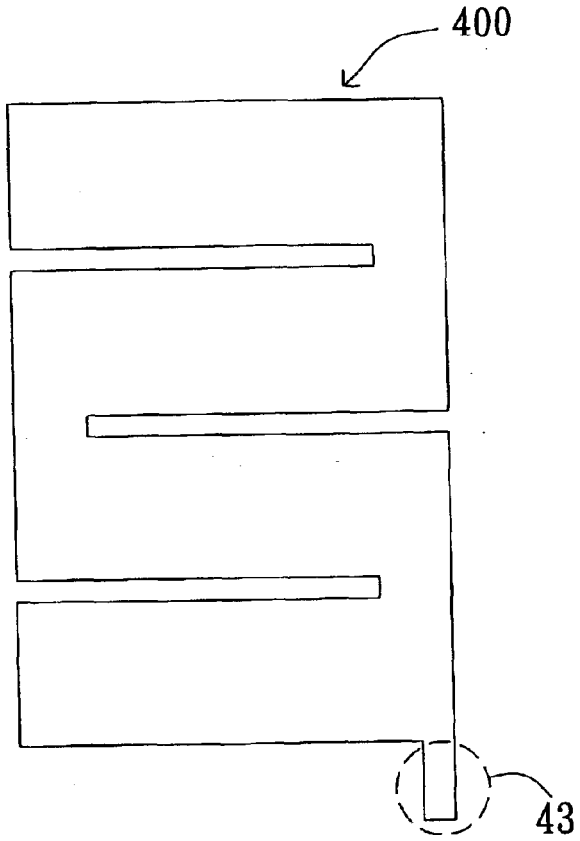
FIG. 4A illustrates the radiation body formed with a conductor of the folded antenna apparatus in a unity form.
Figure 4B:
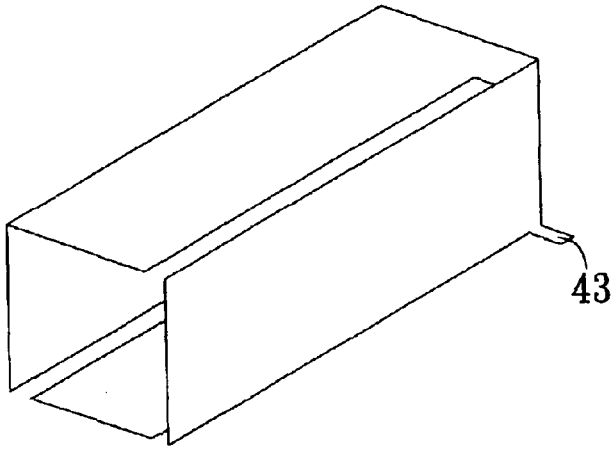
FIG. 4B illustrates a folded state of the radiation body of FIG. 4A.

The conductor 33 is not limited to a separating part from the monopole antenna. It can be integrated with the radiation body 100 or the transmission line 31 for simplifying the structure of the monopole antenna. Referring next to FIG. 4A, it illustrates the radiation body 400 integrated with the conductor 43 of the folded antenna apparatus of the invention. The radiation body 400 and the conductor 43 are integrated on the same metal plate to form a unity structure. After the radiation body 400 is folded, the conductor 43 is naturally connected with the folded radiation body 400 simultaneously, as shown in FIG. 4B. If one uses a microstrip line as a transmission line, the conductor 43 and the microstrip line can be formed on the circuit board simultaneously by printing technology or etching technology (the conductor can be regards as an extended part of the microstrip line here, while the difference between the conductor and the microstrip line is that the bottom of the conductor does not have a grounding surface). If one uses a coaxial cable as a transmission line, part of the top of the coaxial cable can be stripped off to expose the core line of the coaxial cable (to strip the metal covering the grounding surface off). The exposed core line of the coaxial cable acts as a conductor, and the covered (unexposed) core line of the coaxial cable acts as a transmission line. The foregoing conductor and transmission line is naturally in a unity form.

The radiation body can be combined with the transmission line by surface-mount technology (SMT) to facilitate the manufacturing process, no matter where the conductor is formed on, the transmission line or the radiation body. That is, the radiation body of the invention can be a standard SMT device to be combined with the circuit board for simplifying the manufacturing process and reducing the cost.

The following description shows the experimental data to proof the performance of the preferred embodiment of the invention. Currently, the mobile phones are usually used in the GSM band or the DCS band. In this experiment, the operating frequency of the monopole antenna is set at 900 MHz and 1800 MHz. The width of the folded radiation body is about 34 mm, the thickness of the folded radiation body is about 9 mm, and the height of the folded radiation body is about 9 mm from the grounding surface (the height of the folded radiation body is about 3.6% of the wavelength corresponding to the 900 MHz). The foregoing size of the folded radiation body allows the folded radiation body to be built in the case of the conventional mobile phones. By this design, the antenna can be embedded.

Figure 5:
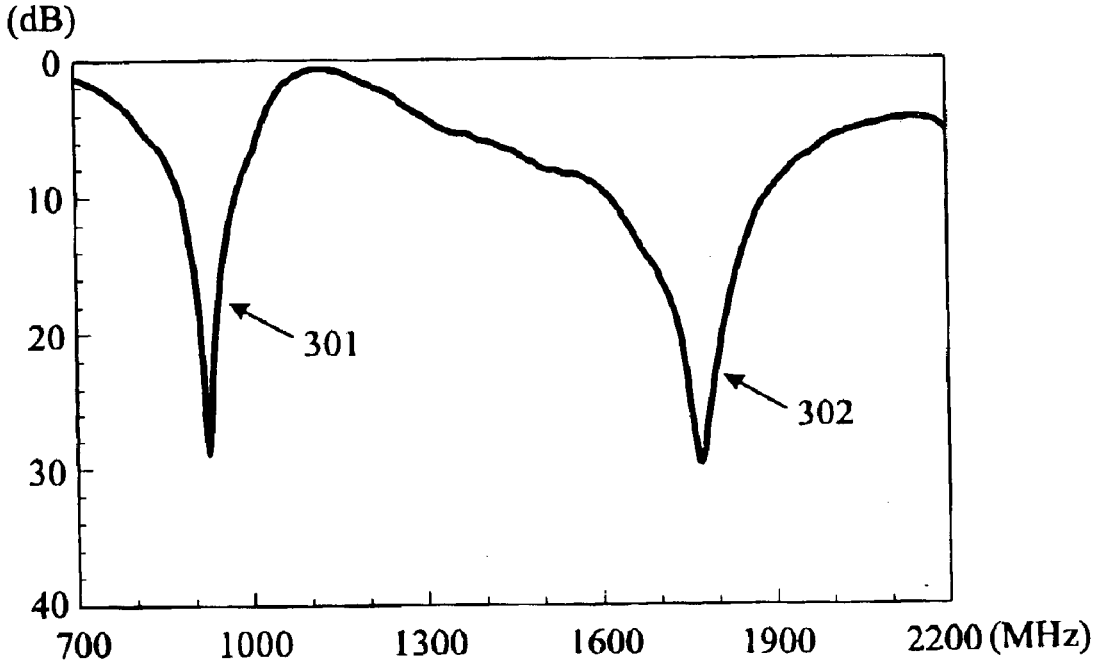
FIG. 5 is a chart illustrating a measurement of return loss for the folded antenna apparatus.

Referring next to FIG. 5, it illustrates the measurement of return loss for the folded antenna apparatus. According to the requirement that the return loss is larger than 10 dB, the frequency band measured at the low operating frequency mode 301 is about 94 MHz (879~973 MHz) and the frequency band measured at the high operating frequency mode 302 is about 270 MHz (1710~1880 MHz). The foregoing two frequency bands cover the frequency bands GSM (890~960 MHz) and DCS (1710~1880 MHz) of the mobile communication system. Good operating performance at the foregoing frequency bands of the invention is obtained.

Figure 6A:
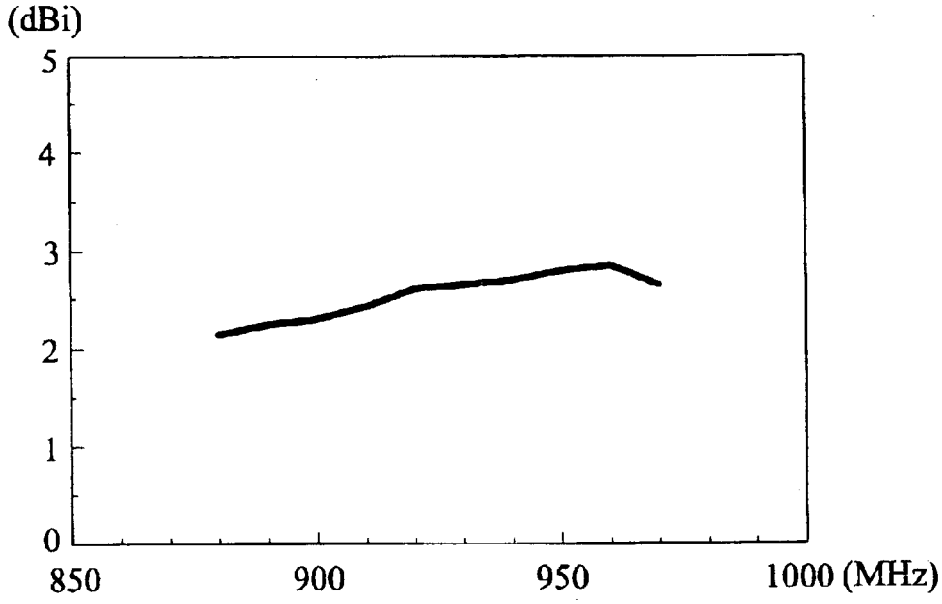
FIG. 6A is a chart illustrating a measurement of antenna gain in the GSM band for the folded antenna apparatus.
Figure 6B:
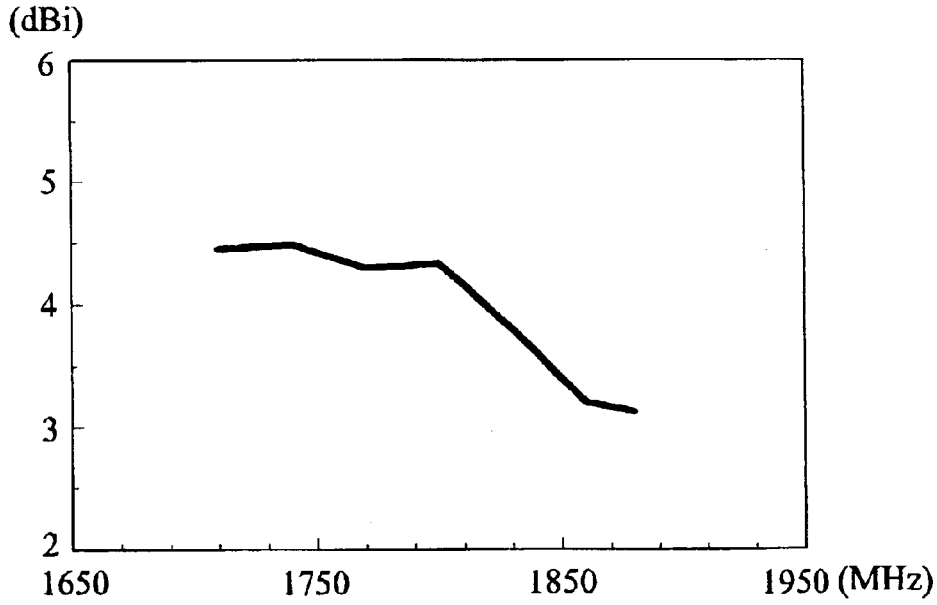
FIG. 6B is a chart illustrating a measurement of antenna gain in the DCS band for the folded antenna apparatus.

Referring to FIG. 6A, it is a chart illustrating the result of measuring the antenna gain in the GSM band for the folded antenna apparatus. FIG. 6B is a chart illustrating the antenna gain in the DCS band for the folded antenna apparatus. The antenna gain measured in the GSM band is within a range of 2.0~3.0 dBi, and the antenna gain measured in the DCS band is within a range of 3.0~4.5 dBi. The operating performance of the foregoing antenna gains of the invention is highly satisfied.

As described above, a plurality of slits can be alternately set at two sides of the radiation body to form a meandered structure. By the positioning of the feeding point, two current paths with different lengths are defined and thus the antenna resonates at two different operating frequencies. That is, the length of the current path controls the operating frequency. The operating frequency is accordingly modulated by modulating the length of the current path.

Figure 7A:
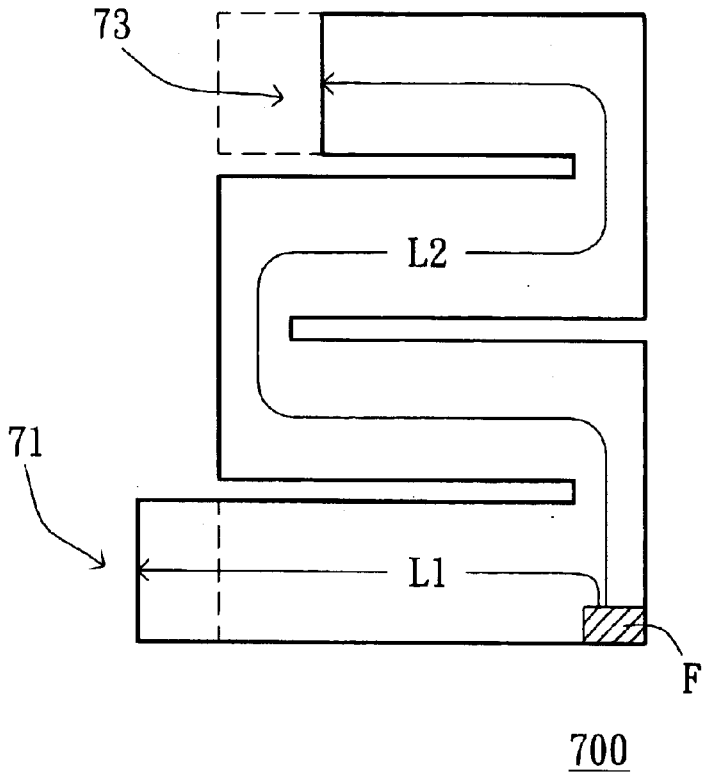
FIG. 7A illustrates a method of modulating the current path of the radiation body of the folded antenna apparatus.
Figure 7B:
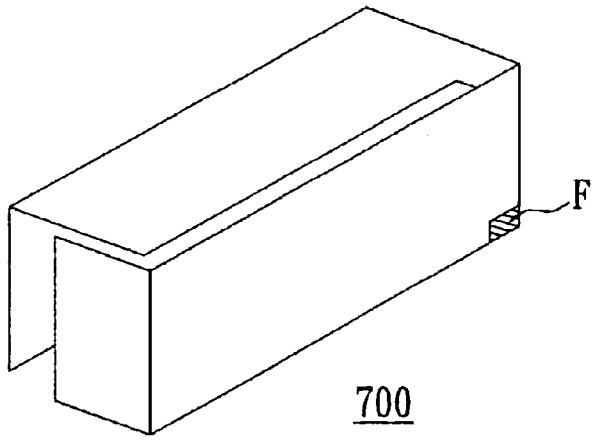
FIG. 7B illustrates a folded state of the radiation body of FIG. 7A.

Referring to FIG. 7A, it illustrates a method of modulating the current path of the radiation body of the folded antenna apparatus. The start point of the current path L1 is the feeding point F, and the end point of the current path L1 is the opening end 71 at one side of the radiation body. The start point of the current path L2 is the feeding point F, and the end point of the current path L2 is the opening end 73 at one side of the radiation body. Obviously, the protruding of the opening end 71 from one side of the radiation body causes the extending of the current path L1 and the lowering of the high operating frequency. On the contrary, the recessing of the opening end 73 from one side of the radiation body results in the decreasing of the length of the current path L2 and the increasing of the low operating frequency. By the modulating method of the invention as described above, the operating frequency can be modulated. The folded radiation body 700 is shown in FIG. 7B.

It should be noted that the designs presented above are only taken for example, and they are not used to define the limitations of the invention. According to the invention, any person who has known this art can adjust these design parameters to the design achieving the similar functionality without departing from the spirit of the invention.

As disclosed in the embodiment according to the invention above, the advantages of the folded dual-band antenna structure are describer as follows.

The monopole antenna of the invention can be applied to a small size wireless communication devises including personal mobile communication devices and systems compliant to different standards, such as global system for mobile communications (GSM) 900/1800 and digital communication system (DCS) 1800/1900. The characteristic of the monopole antenna is that it resonates at a quarter of operating wavelength, while the dipole antenna resonates at a half of operating wavelength. The resonance length of the monopole antenna is only a half of the dipole antenna. With this advantage, the monopole antenna of invention can be widely applied to any small size wireless communication devises.

For further reducing the length of the monopole antenna, a meandered structure is conventionally used to increase the length of the surface current path and to decrease the operating frequency. However, the conventional method can only be used at single frequency for the monopole antenna, and has little contribution in size miniaturization of the monopole antenna.

The invention provides an improved dual-band monopole antenna structure with the advantages of size miniaturization and dual frequency band operation. Furthermore, the dual-band monopole antenna of the invention can be easily manufactured and costs much less than the conventional method. Also, two different current paths can be excited simultaneously by a single one feeding point. In addition, according to the spirit of the invention, a conventional planar antenna can be size-reduced without harming its performance, by folding it as a three-dimensional pillar structure. To sum up, the dualband monopole antenna of the invention is of great value in industrial application.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A folded dualband antenna apparatus with a first operating frequency and a second operating frequency, comprising:

a radiation body with a first side and a second side corresponding to the first side, the radiation body including:

a plurality of slits, set alternately on the first side and the second side; and a feeding point for defining a first current path and a second current path on the radiation body, wherein the length of the first current path is a quarter of a wavelength corresponding to the first operating frequency, and the length of the second current path is a quarter of a wavelength corresponding to the second operating frequency;

wherein the radiation body is folded along an extended direction of the slits to form a pillar structure;

a transmission line for transmitting signals; and a conductor, connecting the transmission line and the feeding point of the radiation body.

2. A folded dual-band antenna apparatus according to claim 1, wherein the conductor and the radiation body are combined in a unity form.

3. A folded dualband antenna apparatus according to claim 1, wherein the radiation body is a rectangular metal plate.

4. A folded dual-band antenna apparatus according to claim 1, wherein the first operating frequency is about 900 MHz, and the second operating frequency is about 1800 MHz.

5. A folded dual-band antenna apparatus according to claim 1, wherein the directions of the slits are parallel to each other.

6. A folded dual-band antenna apparatus according to claim 1, further comprising a pillar dielectric material, the radiation body formed on the surface of the pillar dielectric material.

7. A folded dual-band antenna apparatus according to claim 6, wherein the pillar dielectric material is a ceramic material.

8. A folded dual-band antenna apparatus according to claim 6, wherein the radiation body is set on the surface of the pillar dielectric material using a printing technology.

9. A folded dual-band antenna apparatus according to claim 1, wherein the pillar structure is a rectangular pillar structure.

10. A folded dual-band antenna apparatus according to claim 1, wherein the pillar structure is a cylindrical structure.

* * * * *